US012055029B2

(12) United States Patent
Al-Rubaii et al.

(10) Patent No.: US 12,055,029 B2
(45) Date of Patent: Aug. 6, 2024

(54) WELLBORE DRILLING SYSTEM

(71) Applicant: Saudi Arabian Oil Company, Dhahran (SA)

(72) Inventors: Mohammed Murif Hassan Al-Rubaii, Dammam (SA); Saleh Mohammed Al-Harbi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/582,825

(22) Filed: Jan. 24, 2022

(65) Prior Publication Data

US 2023/0235657 A1 Jul. 27, 2023

(51) Int. Cl.
*E21B 44/02* (2006.01)
*E21B 45/00* (2006.01)

(52) U.S. Cl.
CPC ..... *E21B 44/02* (2013.01); *E21B 45/00* (2013.01)

(58) Field of Classification Search
CPC ..... E21B 44/00; E21B 44/02; E21B 45/00
See application file for complete search history.

(56) References Cited

U.S. PATENT DOCUMENTS 10,221,671 B1 3/2019 Zhang
2010/0191471 A1* 7/2010 de Reynal ..... E21B 49/003 702/9
2013/0292178 A1 11/2013 Burress et al.
2015/0142318 A1* 5/2015 Hildebrand ..... E21B 19/00 702/9
2018/0328127 A1 11/2018 Ravi et al.
2019/0316457 A1 10/2019 Al-Rubaii et al.
2020/0362694 A1* 11/2020 Al-Rubaii ..... E21B 47/06

OTHER PUBLICATIONS

Armenta et al., "Identifying Inefficient Drilling Conditions Using Drilling-Specific Energy," presented at The 2008 Annual Technical Conference and Exhibition Held in Denver, Colorado, Sep. 2008, 16 pages.
Dupriest et al., "Maximizing Drill Rates with Real-Time Surveillance of Mechanical Specific Energy," SPE/IADC Drilling Conference, Society of Petroleum Engineers, 2005, 10 pages.
Godhavn et al., "Significant Surge and Swab Offshore Brazil Induced by Rig Heave During Drill Pipe Connections," presented at the SPE/IADC Managed Pressure Drilling and Underbalanced Operations Conference and Exhibition, Virtual, Oct. 2020; SPE Drilling & Completion, Sep. 2021, 8 pages.
(Continued)

*Primary Examiner* — Kristyn A Hall
(74) *Attorney, Agent, or Firm* — Fish & Richardson P.C.

(57) ABSTRACT

Disclosed are methods, systems, and computer-readable medium to perform operations including: receiving real-time drilling data of a drilling operation of drilling a wellbore; using the drilling data to calculate at least one indicator of a tripping operation performed during the drilling operation; detecting, based on the least one indicator of the tripping operation, a drilling problem with the drilling operation; determining a corrective action to avoid or mitigate the drilling problem; and performing the corrective action to avoid or mitigate the drilling problem.

17 Claims, 4 Drawing Sheets

(56) References Cited

OTHER PUBLICATIONS

Pessier et al., "Quantifying Common Drilling Problems with Mechanical Specific Energy and A Bit-Specific Coefficient of Sliding Friction," SPE Annual Technical Conference and Exhibition, Society of Petroleum Engineers, 1992, 16 pages.
Rabia et al., "Specific Energy as a Criterion for Bit Selection," Jul. 1985, Society of Petroleum Engineers, 5 pages.
Samuel et al., "Field Validation of Transient Swab-Surge Response With Real-Time Downhole Pressure Data," SPE Drill & Completion, 2003, 18:280-283, 4 pages.
Teale et al., "The Concept of Specific Energy in Rock Drilling," International Journal of Rock Mechanics and Mining Sciences, 1965, 2:57-73, 17 pages.

* cited by examiner

WELLBORE DRILLING SYSTEM

TECHNICAL FIELD

This disclosure relates to a wellbore drilling system.

BACKGROUND

In wellbore drilling operations, a drilling system causes a drill bit to rotate when in contact with a formation. The rotation of the drill bit breaks and fractures the formation to form the wellbore. The portions of the formation that are broken off during drilling are referred to as "formation cuttings." In order to remove the cuttings from the wellbore, the drilling system circulates a drilling fluid (also referred to as "drilling mud" or "mud") to the drill bit. The drilling fluid exits through drill bit nozzles to the bottom of the wellbore. The drilling fluid carries the formation cuttings from the wellbore to the surface. The ability of the drilling fluid to carry the formation cuttings out of the wellbore is referred to as a carrying capacity of the drilling fluid.

Also in wellbore drilling operations, a drilling pipe may be removed and/or replaced from the wellbore in an operation called a "tripping operation." A tripping operation can be performed for many reasons including changing a component of a drill string (e.g., a drilling bit) or running tests in the wellbore. A tripping operation may affect the pressure within the well (e.g., bottom hole pressure). The pressure effects due to tripping operations are called surge and swab. Surge is additional pressure due to the downward movement of the drill string, and swab is the reduction of pressure due to the upward movement of the drilling string

SUMMARY

In existing drilling systems, tripping operations can experience issues or failures that result in drilling problems, such as wellbore hole problems, potential loss of circulation, unsatisfactory/non-optimal well drilling performance. For example, running the drill string at an excessive velocity induce hole problems. Existing drilling systems do not have safeguards or systems in place that proactively prevent tripping operations from inducing drilling problems. Many existing systems do not even provide real-time pipe velocity.

This disclosure describes methods and system for enhancing well drilling and rig performance by real-time monitoring and evaluation of tripping operations. In one embodiment, a system generates real-time models of surge and swab pressure profiles for a well. The system monitors and evaluates the generated profiles. By monitoring and evaluating the profiles, the system can identify indicators of drilling problems (e.g., wellbore hole problems, potential loss of circulation, unsatisfactory/non-optimal well drilling performance, etc.). The system can then perform an action to avoid or resolve the identified problems. By doing so, the system enables real-time intervention before a more serious issue, such as loss of circulation in the wellbore, occurs.

In accordance with one aspect of the present disclosure, a computer-implemented method involves: receiving real-time drilling data of a drilling operation of drilling a wellbore; using the drilling data to calculate at least one indicator of a tripping operation performed during the drilling operation; detecting, based on the least one indicator of the tripping operation, a drilling problem with the drilling operation; determining a corrective action to avoid or mitigate the drilling problem; and performing the corrective action to avoid or mitigate the drilling problem.

Other versions include corresponding systems, apparatus, and computer programs to perform the actions of methods defined by instructions encoded on computer readable storage devices. These and other versions may optionally include one or more of the following features.

In some implementations, performing the corrective action includes: controlling the drilling system to adjust one or more drilling parameters that avoid or mitigate the drilling problem.

In some implementations, the drilling parameter is a movement speed of a drill pipe.

In some implementations, controlling, based on the least one indicator of the tripping operation, a component of the drilling system to adjust at least one of the drilling parameters includes: determining, based on the real-time drilling data, a rate of penetration for a drilling tool of the drilling system; and controlling the drilling tool such that the rate of penetration of the drilling tool is less than or equal to the determined rate of penetration.

In some implementations, determining the rate of penetration for the drilling tool is further based on a pore pressure limit and a fracture pressure limit.

In some implementations, the least one indicator of the tripping operation includes a surge pressure profile.

In some implementations, calculating at least one indicator of the tripping operation is based on at least one of: (1) a modified carrying capacity index (CCI), (2) a modified cuttings concentration in annulus (CCA), (3) a transport ratio (TR) efficiency (TRE), (4) an effective drilling fluid density (MWeff), (5) an equivalent circulating density (ECD), or (6) transport index (TI).

Particular implementations of the subject matter described in this specification can be implemented so as to realize one or more of the following advantages. As an example, implementation of the subject matter detects drilling problems and performs actions that avoid or resolve the detected problems. By doing so, the system enables real-time intervention before a more serious issue, such as loss of circulation in the wellbore, occurs. As such, implementation of the subject matter ensures proper and optimum tripping operations performance. Doing so also improves rig efficiency. As another example, implementation of the subject matter minimizes drilling problems, such as lost circulation and loss of well control. As yet another example, implementation of the subject matter achieves an improved output efficiency of tripping performance. Furthermore, implementation of the subject matter accounts for physical and chemical effects of drilling mud rheology during surge and swab calculations.

The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

Figure 1:
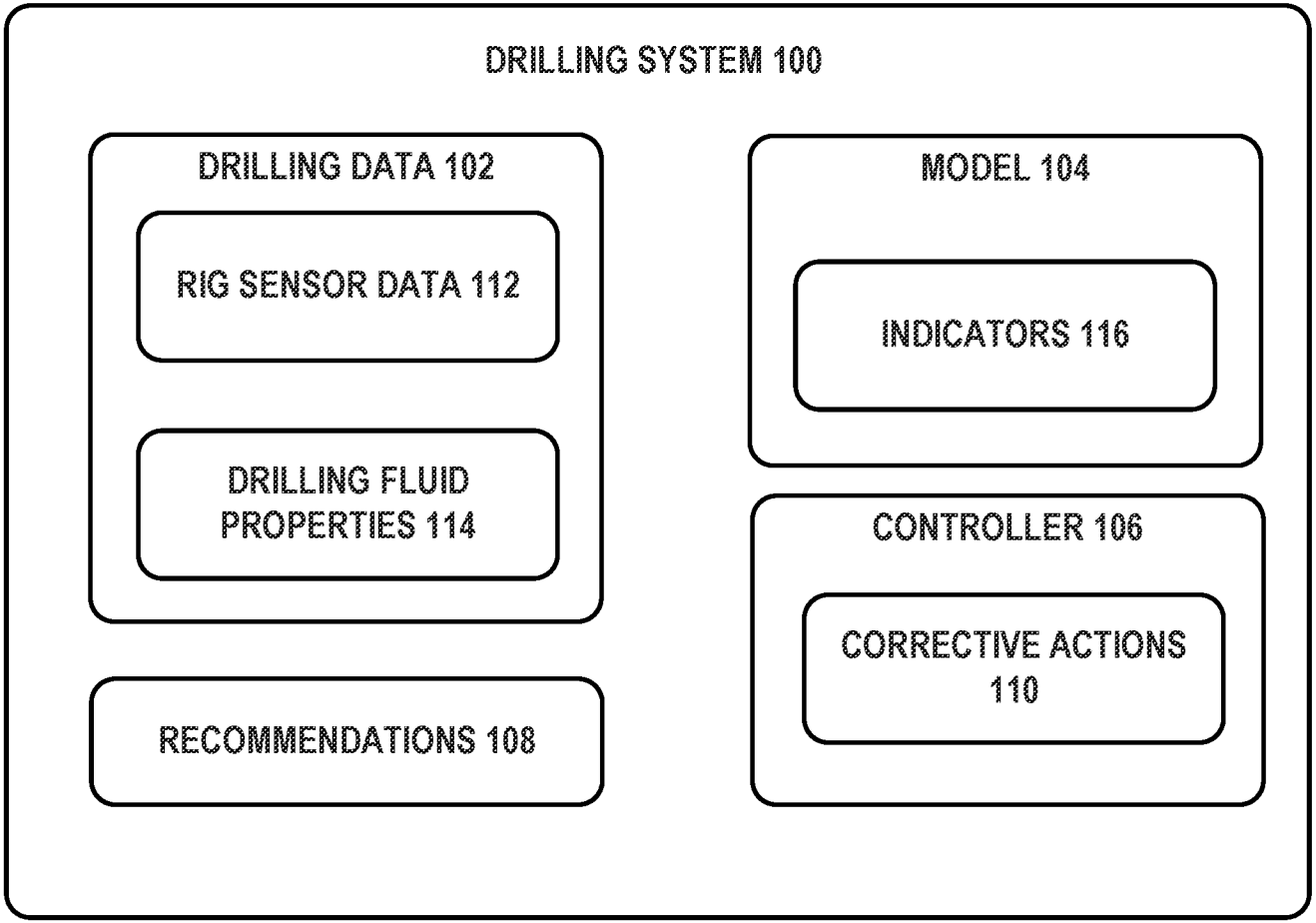
FIG. 1 illustrates a system, in accordance with some embodiments.

A tripping operation refers to the process of removing and/or replacing a pipe from a well. A tripping operation can be performed for many reasons including changing a component of a drill string (e.g., a drilling bit) or running tests in the wellbore. A tripping operation may affect the pressure within the well (e.g., bottom hole pressure). The pressure effects due to tripping operations are called surge and swab. Surge is additional pressure due to the downward movement of the drill string, and swab is the reduction of pressure due to the upward movement of the drilling string.

In existing drilling systems, tripping operations can experience issues or failures that result in drilling problems, such as wellbore hole problems, potential loss of circulation, unsatisfactory/non-optimal well drilling performance. One of the ways that tripping operations cause drilling problems is by affecting the pressure within a wellbore, e.g., due to the movement of the pipe. For example, surge (additional pressure due to pipe movement) may increase the pressure that is exerted on the formation, which may fracture the formation. Fracturing the formation results in drilling problems, such as loss of circulation or even potential loss of the wellbore. Swab (reduction of pressure due to pipe movement) may also cause drilling problems. For example, if swab reduces pressures in the wellbore to a certain extent, reservoir fluids may flow into the wellbore, which can cause drilling problems like kick and reduction of wellbore stability.

This disclosure describes methods and system for enhancing well drilling and rig performance by real-time monitoring and evaluation of tripping operations. In one embodiment, a system generates real-time models of surge and swab pressure profiles for a well. The system monitors and evaluates the generated profiles. By monitoring and evaluating the profiles, the system can identify indicators of drilling problems (e.g., wellbore hole problems, potential loss of circulation, unsatisfactory/non-optimal well drilling performance, etc.). The system can then perform an action to avoid or resolve the identified problems. By doing so, the system enables real-time intervention before a more serious issue, such as loss of circulation in the wellbore, occurs.

As described in more detail below, one of the ways that the system identifies drilling problems is by evaluating how a tripping operation affects one or more drilling indicators in the wellbore. In an example, the system uses equivalent circulating density (ECD), which represents a pressure that is exerted on a wellbore, as an indicator. ECD is a function of a density of the drilling fluid and pressures in the wellbore, such as the hydrostatic pressure of the drilling fluid and pressures due to pipe movement (e.g., surge and swab pressures). As such, a tripping operation can affect ECD, and the system can monitor ECD to determine how the tripping operation is affecting the wellbore. Among other things, ECD can be used to determine a pressure in the wellbore and can be used as an indicator of the cleanliness of the wellbore (e.g., by representing an amount of cuttings in the wellbore).

FIG. 1 illustrates a system 100, according to some embodiments. In one embodiment, the system 100 is implemented using a computer system, such as the computer system 300 of FIG. 3. As described in FIG. 3, the computer system 300 can communicate with one or more other computer systems over one or more networks. Note that the system 100 is shown for illustration purposes only, as the system 100 can include additional components or have one or more components removed without departing from the scope of the disclosure. Further, note that the various components of the system 100 can be arranged or connected in any manner.

In some embodiments, the system 100 is a computer-based system that is configured to generate real-time models of a drilling operation, use the models to monitor the drilling operation, identify indicators of a drilling problem, and perform an action in response to identifying an indicator of a drilling problem. The real-time models include real-time models of surge and swab pressure profiles of a well. Accordingly, the system 100 monitors and evaluates the surge and swab pressure profiles during the drilling operation. As described in more detail below, monitoring and evaluating the surge and swab pressure profiles enables the system 100 to improve the drilling operation, for example, by proactively avoiding drilling problems or reactively mitigating a detected drilling problem. In one example, the system 100 is configured to generate recommendations 108 that improve the drilling operation. The system 100 can provide drilling teams (or operators) with the recommendations, perhaps, by displaying the recommendation on a user device display or by providing a user notification (for example, an audible, visual, or tactile alert). Additionally or alternatively, the system 100 can take actions based on the surge and swab pressure profiles or the generated recommendations, such as corrective actions that mitigate detected drilling problems, actions that proactively improve the drilling operation, or both.

In some embodiments, the system 100 receives drilling data 102. As shown in FIG. 1, the drilling data 102 includes rig sensor data 112 and drilling fluid (mud) properties 114. The rig sensor data 112 includes data that has been measured by rig sensors, such as surface rig sensors and other devices that are configured for real-time surface and down-wellbore measurements. Examples of the rig sensor data 112 include measurement-while-drilling (MWD) data, logging-while-drilling (LWD) data, drilling rate, rate of penetration (ROP), torque (that is, the movement required to rotate the drilling pipe), spindle speed (that is, the rotation frequency of the spindle of the drilling system, measured in RPM), weight on bit (that is, the amount of downward force exerted on the drilling bit provided by the thick-walled tubular pieces in the drilling assembly), and standard pipe pressure (that is, the summation of pressure loss in annulus, pressure loss in drill string, pressure loss in bottom hole assembly (BHA) and pressure loss across the bit), mudflow volume, mud pressure, mud resistivity, gas readings, among other examples. Examples of the mud or drilling fluid properties 114 includes drilling fluid density, viscosity, yield point, gel strength, filtration, and rheology. Other examples of the drilling data 102 include a hole size of the borehole and dimensions of the drill pipe.

In some embodiments, the system 100 uses a model 104 that represents the drilling operation in order to interpret the drilling data 102. The model 104 can be a real-time model of the drilling operation. The system 100 generates the model 104 based on a plurality of predetermined mathematical equations that define parameters for evaluating surge and swab pressures of the drilling operation. In an example, the model 104 is configured to use the drilling data 102 to calculate one or more of the following pressure indicators 116: (i) pressure of surge due to pressure loss of running pipe (PS) in pounds per square inch (PSI), (ii) effective annular velocity (Ve) in feet/second (ft/s), (iii) annular mud velocity due to pipe motion (Vm) in ft/s, (iv) pipe velocity of running or pull out of hole (Vp) in ft/s or ft/minute (ft/min), and (v) maximum pipe velocity due to tripping operations (Vpm) in ft/s. The pressure indicators 116 enable the system 100 to evaluate the surge and swab pressures of the drilling operation. Based on the surge and swab pressures, the system 100 can detect potential drilling problems, determine corrective actions to mitigate potential or actual drilling problems, or generate recommendations 108 for improving the drilling operation.

In some embodiments, the model 104 accounts for one or more of the following drilling operation factors: (1) plastic viscosity (PV) of the drilling fluid in Centi Poise (CP), (2) yield point of the drilling fluid in pounds/100 square feet (lb/100 sqft), (3) drill-pipe outer diameter (DP) in inches (in), (4) open hole diameter (OH) in inches, (5) drilling fluid weight or mud weight (MW) in pounds per gallon (PPG), (6) flow behavior index, n, (dimensionless), (7) flow consistency index, k, (dimensionless), (8) Clinging Constant (k), (9) viscometer reading at 600 (R600) rotations per minute (RPM), (10) viscometer reading at 300 RPM (R300), (11) viscometer reading at 6 RPM (R6), (12) viscometer reading at 3 RPM (R3), (13) initial gel strength, Gsi, of drilling mud in lb/100 $ft^2$ measured at 10 seconds from being in a static state, (14) final gel strength, Gsf, in lb/100 $ft^2$ (at 10 min and/or 30 min from being in a static state), (15) low shared yield point (LSYP), (16) pH, (17) electrical stability (Es) in volts (V), (18) pipe running depth (PD) in ft, and (19) a cuttings diameter (DC) in inches.

In some embodiments, the model 104 enables the system 100 to increase a running pipe velocity without inducing any hole problems, thereby ensuring smooth drilling operations relative to rig efficiency. The model 104 is also configured to utilize the surface rig sensors and mud rheological properties to interpret downhole conditions by accounting for properties such as drilling fluids density, rheology, and pipe velocities. The model 104 enables monitoring, evaluation, optimization, and actions for improving the performance and efficiency of tripping operations. Doing so helps mitigate hole problems and improves rig efficiency, thereby resulting in safer and more economical wells than achievable using existing technology.

In some embodiments, the model 104 calculates the pressure indicators 116 using Equations [1]-[18] defined below. More specifically, Equations [1]-[9] are used to calculate an effective annular velocity and Equations [10]-[18] are used to calculate surge pressure influences.

$$V_e = Vm - 0.5\,kVp \quad [1]$$

In Equation [1], Ve is an effective annular velocity in ft/s, Vm is an annular mud velocity due to pipe motion in ft/s, k is flow consistency index (dimensionless), and Vp is a pipe velocity of running or pull out of hole in ft/s. In some examples, Vp can be calculated using Equation [2], k can be calculated using Equations [3]-[5], and Vm using one of Equations [6], [7], [8], [9]. More specifically, k is calculated in Equation [5] as a sum of Equations [3]-[4], where k1 is a flow consistency around a drill pipe and k2 is a flow consistency around a drill collar.

$$V_p = \frac{\text{Depth1} + \text{Depth2}}{\text{Depth1}}(60) \quad [2]$$

In Equation [2], Depth 1 is a last casing measured depth or a starting depth, and Depth 2 is the drilled depth.

$$k1 = 0.275\left(\frac{DP}{OH}\right) + 0.25 \quad [3]$$

$$k2 = 0.1\left(\frac{Dc}{OH}\right) + 0.41 \quad [4]$$

$$k = 0.275\left(\frac{DP}{OH}\right) + 0.25 + 0.1\left(\frac{Dc}{OH}\right) + 0.41 \quad [5]$$

In some embodiments, Vm is calculated using one of Equations [6], [7], [8], [9]. Equation [6] is used to calculated Vm of running in hole for a closed-ended or plugged drill pipe, Equation [7] is used to calculate Vm of pull out of hole for a closed-ended or plugged drill pipe, Equation [8] is used to calculate Vm of running in hole for an open-ended drill pipe, and Equation [9] is used to calculate Vm of pull out of hole for open-ended drill pipe.

$$Vm = -(-Vp)\left(\frac{DP^2}{OH^2 - DP^2} + \frac{DC^2}{OH^2 - DC^2}\right); \quad [6]$$

$$Vm = -(Vp)\left(\frac{DP^2}{OH^2 - DP^2} + \frac{DC^2}{OH^2 - DC^2}\right); \quad [7]$$

$$Vm = -(-Vp)\left(\frac{((4DP^2(OH - DP)^2 - 3DP^2))}{(4DP^2(OH - DP)^2(OH^2 - DP^2) + 6DP^4)} + \frac{((4DC^2(OH - DC)^2 - 3DC^2))}{(4DC^2(OH - DC)^2(OH^2 - DC^2) + 6DC^4)}\right); \quad [8]$$

$$Vm = -Vp\left(\frac{((4DP^2(OH - DP)^2 - 3DP^2))}{(4DP^2(OH - DP)^2(OH^2 - DP^2) + 6DP^4)} + \frac{((4DC^2(OH - DC)^2 - 3DC^2))}{(4DC^2(OH - DC)^2(OH^2 - DC^2) + 6DC^4)}\right). \quad [9]$$

In Equations [6]-[9], DP is drill-pipe outer diameter in inches, DC is an outer-diameter of drill collar in inches, OH is open hole diameter in inches.

In some embodiments, a surge pressure (PS) in PSI is calculated as the average of two surge pressures: PS1 and PS2, as shown by Equation [10]:

$$Ps = 0.5(Ps1 + PS2) \quad [10]$$

In these embodiments, PS1 and PS2 are calculated using Equations [11]-[12]:

$$Ps1 = \left(\frac{2.4Vpm}{OH - DP} \times \frac{2n + 1}{3n}\right)^n \times \frac{K(PD)}{300(OH - DP)} \quad [11]$$

$$PS2 = \left(\frac{PVVe}{1000(OH - DP)^2} + \frac{YP}{200(OH - DP)}\right)^1 \times \text{Depth2} \quad [12]$$

In Equation [12], Depth2 is a real-time depth measurement. Thus, this value changes based on drilled depth.

As shown by these equations, PS1 and PS2 are calculated based on a plurality of variables including PV, YP, LSYP, n, K, and Vpm. In an example, these variables are calculated using Equations [13]-[18]:

$$PV = R600 - R300 \quad [13]$$

$$YP = R300 - PV \quad [14]$$

$$LSYP = (2R3 - R6) \quad [15]$$

-continued $$n = 3.32 \log \frac{\left(2PV + YP + \frac{Gsf}{Gsi} + \frac{PH}{9} + \frac{ES}{400}\right)}{\left(YP + PV + LSYP + \frac{Gsf}{Gsi} + \frac{PH}{9} + \frac{ES}{400}\right)} \quad [16]$$

$$K = \frac{\left(YP + PV + LSYP + \frac{Gsf}{Gsi} + \frac{PH}{9} + \frac{ES}{400}\right)}{511^n} \quad [17]$$

$$Vpm = 1.5\ Ve \quad [18]$$

In some embodiments, the system 100 uses the one or more pressure indicators 116 to evaluate how a tripping operation is affecting one or more drilling parameters in the wellbore. In an example, the system uses equivalent circulating density (ECD), which represents a pressure that is exerted on a wellbore, as the drilling parameter. More specifically, the system 100 uses the one or more pressure indicators 116 to calculate ECD. In one example, ECD is calculated using Equation [19]:

$$ECD=BHCP/(0.052*TVD) \quad [19]$$

In Equation [19], ECD is equivalent circulating density in pounds per gallon (ppg), BHCP is bottom hole circulating pressure (psi), and TVD is true vertical depth in feet. TVD refers to the vertical distance from a point in the well (e.g., the current depth) to a point at the surface (e.g., elevation of the rotary kelly bushing). In an example, BHCP is calculated as the sum of hydrostatic pressure (HP) in psi and surge/swab pressure (PS) in psi.

Then, the system 100 uses the value of ECD to determine if there is a drilling problem. As an example, the system 100 can use the value of ECD to determine if the pressure increase due to the tripping operation could cause a formation fracture or other drilling problem due to excessive wellbore pressure. Specifically, the system 100 can identify pressure changes due to the tripping operation at which the ECD causes a wellbore pressure greater than a formation pore pressure. As another example, the system 100 can use the value of ECD to evaluate the cleanliness of the wellbore. As yet another example, the system 100 can use the value of ECD to determine if the pressure decrease due to the tripping operation could cause a kick or some other drilling problem due to reduced pressure.

In some embodiments, the system 100 uses the model 104 to continuously or periodically monitor and evaluate tripping operations to avoid hole problems and improve well drilling performance. For example, the system 100 is configured to intervene by performing a corrective action 110 when a drilling problem or a potential drilling problem is detected. Furthermore, the system 100 can send instructions to other drilling tools or systems to perform actions 110 that avoid hole problems or improve well drilling performance.

In some embodiments, the system 100 can determine an action that counteracts the increase or decrease in pressure caused by the tripping operation, thereby avoiding or mitigating the drilling problems caused by the tripping operation. As an example, the system 100 can determine, based on the one or more pressure indicators 116, the mud weight of the drilling fluid. As explained above, the mud weight affects the total pressure exerted on the formation, and therefore, adjusting the mud weight can counteract the pressure changes due to the tripping operation. The relationship between mud weight and ECD is defined by Equation [20]:

$$ECD=MW+PS/(0.052*TVD) \quad [20]$$

In Equation [20], ECD is equivalent circulating density in pounds per gallon (ppg), MW is mud weight in ppg, PS is the surge/swab pressure in psi, and TVD is true vertical depth in feet.

As another example, the system 100 can control, based on the one or more pressure indicators 116, tripping operation speed (e.g., the speed of the movement of the drill pipe). More specifically, the ECD (calculated using pressure indicators 116), a pore pressure limit of the formation, and a fracture pressure limit of the formation are used to calculate the stability of the formation. Then, based on the calculated stability, an acceptable tripping operation speed is calculated. As yet an example, the system 100 can determine, based on the one or more pressure indicators 116, a maximum rate of penetration of the drill pipe. More specifically, the ECD (calculated using pressure indicators 116), a pore pressure limit of the formation, and a fracture pressure limit of the formation are used to calculate the stability of the formation. Then, based on the calculated stability, the maximum rate of penetration is calculated. Additionally, the system 100 can control the rate of penetration, perhaps to be less than the calculated maximum rate. Controlling the rate of penetration allows the system 100 to: (i) avoid fracturing the formation while drilling, (ii) ensure smooth drilling with generated drilling cuttings, and (iii) avoid or mitigate stuck pipe incidents.

In some embodiments, the system 100 can display the recommendations 108 on a display. As an example, the system 100 can display, for example, to drilling teams, a surge pressure profile. The system 100 can also provide drilling teams with continuous monitoring, evaluation, optimization, and recommendations regarding a tripping operation's performance and efficiency. As an example, the system 100 can provide recommendations related to rate of penetration, movement speed of a drill pipe during a tripping operation, and/or mud weight adjustments. As such, the system 100 helps mitigate hole problems and improves drilling rate, which results in safer and more economical wells.

Figure 2:
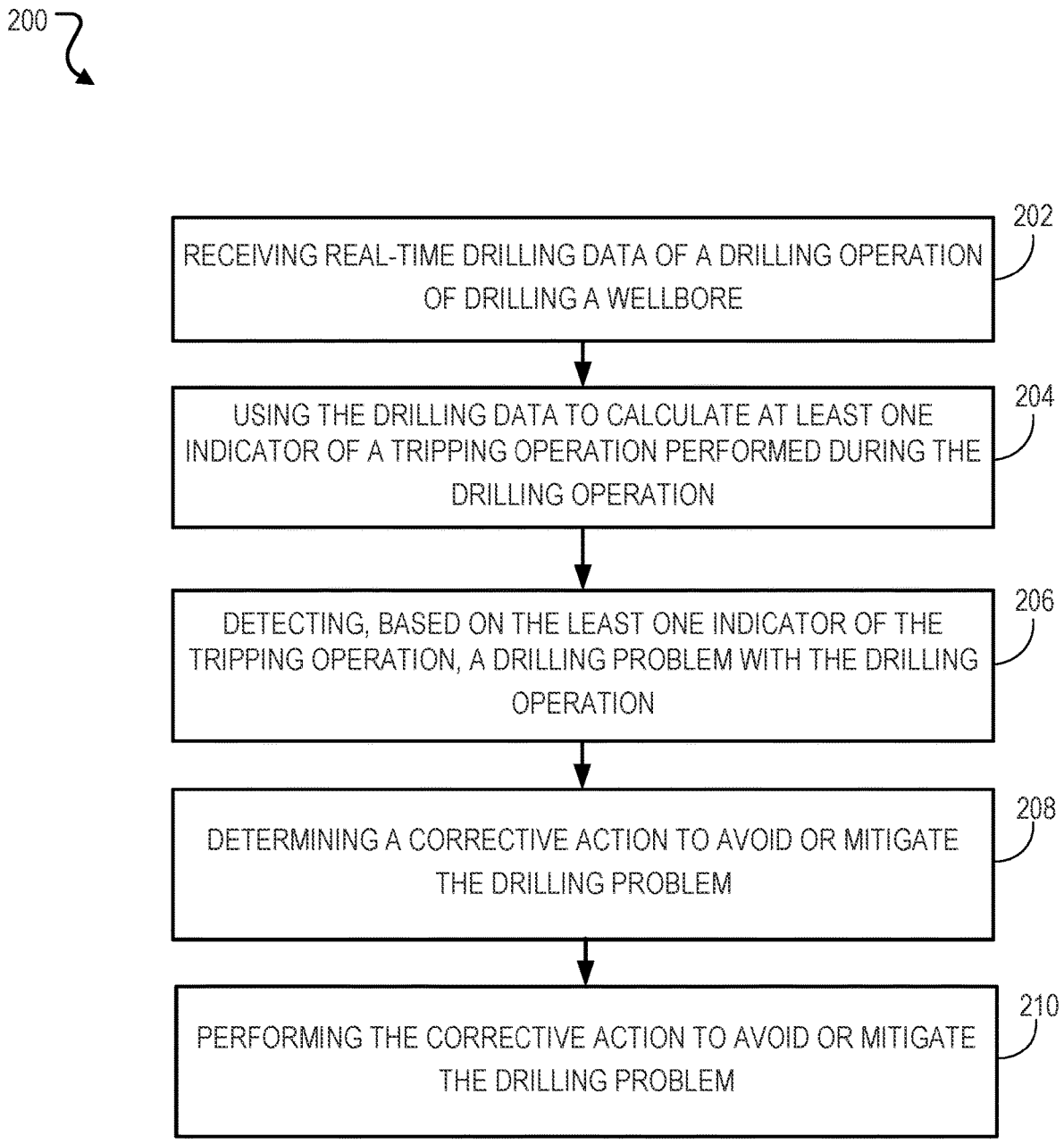
FIG. 2 illustrates a flowchart of an example method, in accordance with some embodiments.

FIG. 2 is a flowchart of an example method 200, according to some implementations. The method 200 is for improving a tripping operation of a borehole drilling operation by calculating and monitoring real-time indicators of the tripping operation. For clarity of presentation, the description that follows generally describes method 200 in the context of the other figures in this description. However, it will be understood that method 200 can be performed, for example, by any suitable system, environment, software, hardware, or a combination of systems, environments, software, and hardware, as appropriate. In some implementations, various steps of method 200 can be run in parallel, in combination, in loops, or in any order.

At step 202, method 200 involves receiving real-time drilling data of a drilling operation of drilling a wellbore.

At step 204, method 200 involves using the drilling data to calculate at least one indicator of a tripping operation performed during the drilling operation.

At step 206, method 200 involves detecting, based on the least one indicator of the tripping operation, a drilling problem with the drilling operation.

At step 208, method 200 involves deter determining a corrective action to avoid or mitigate the drilling problem.

At step 210, method 200 involves performing the corrective action to avoid or mitigate the drilling problem.

In some implementations, performing the corrective action involves controlling the drilling system to adjust one or more drilling parameters that avoid or mitigate the drilling problem.

In some implementations, the drilling parameter is a movement speed of a drill pipe.

In some implementations, controlling, based on the least one indicator of the tripping operation, a component of the drilling system to adjust at least one of the drilling parameters involves: determining, based on the real-time drilling data, a rate of penetration for a drilling tool of the drilling system; and controlling the drilling tool such that the rate of penetration of the drilling tool is less than or equal to the determined rate of penetration.

In some implementations, determining the rate of penetration for the drilling tool is further based on a pore pressure limit and a fracture pressure limit.

In some implementations, performing the corrective action involves displaying, via a graphical user interface (GUI), drilling instructions to perform one or more actions to avoid or mitigate the drilling problem.

In some implementations, the least one indicator of the tripping operation comprises a surge pressure profile.

In some implementations, calculating at least one indicator of the tripping operation is based on at least one of: (1) a modified carrying capacity index (CCI), (2) a modified cuttings concentration in annulus (CCA), (3) a transport ratio (TR) efficiency (TRE), (4) an effective drilling fluid density (MWeff), (5) an equivalent circulating density (ECD), or (6) transport index (TI).

Figure 3:
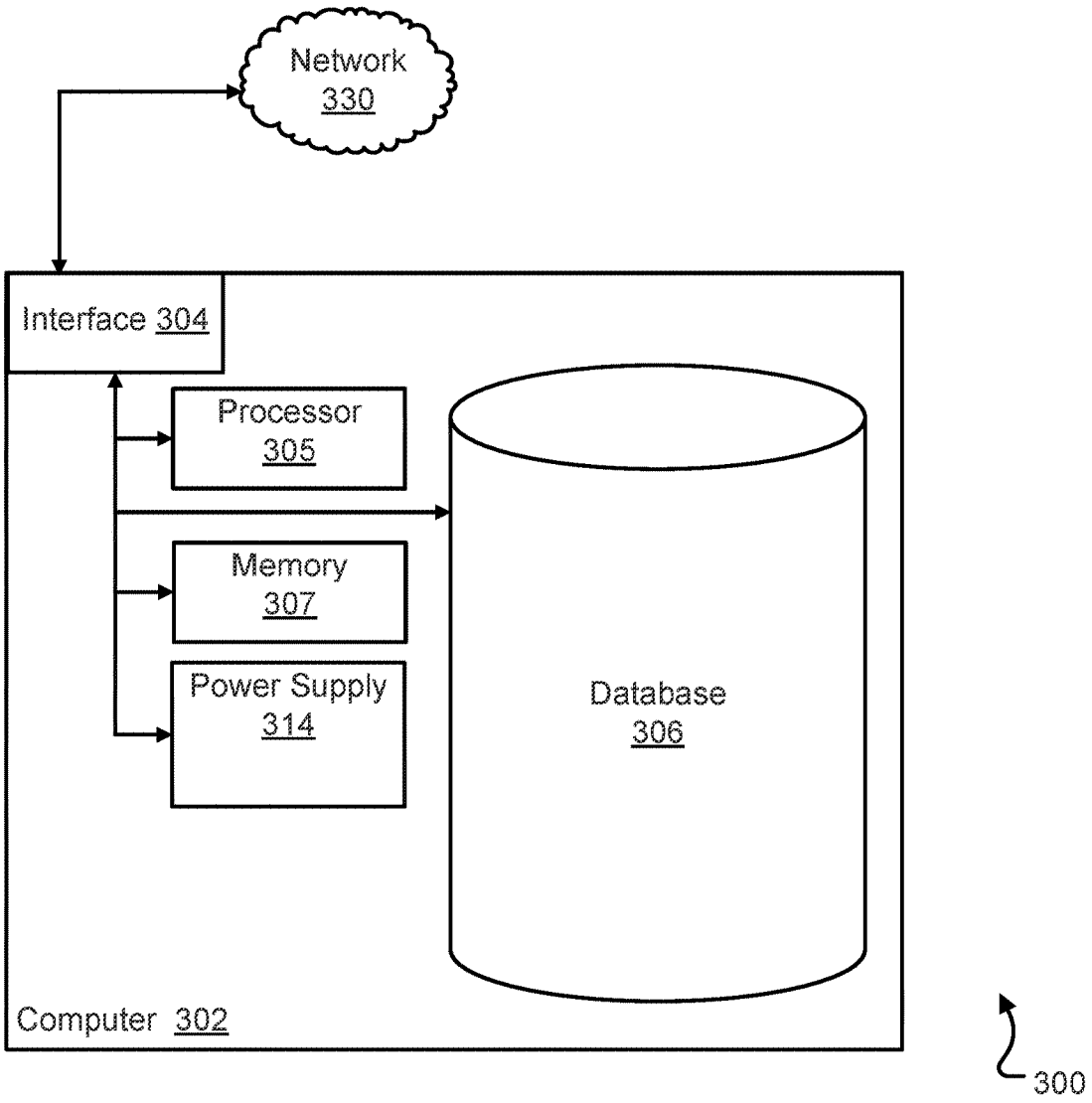
FIG. 3 illustrates an example computing environment for implementing the techniques described herein, in accordance with some embodiments.

FIG. 3 is a block diagram of an example computer system 300 that can be used to provide computational functionalities associated with described algorithms, methods, functions, processes, flows, and procedures described in the present disclosure, according to some implementations of the present disclosure. In some implementations, the system 100 can be the computer system 300, include the computer system 300, or include part of the computer system 300. In some implementations, the system 100 can communicate with the computer system 300.

The illustrated computer 302 is intended to encompass any computing device such as a server, a desktop computer, embedded computer, a laptop/notebook computer, a wireless data port, a smart phone, a personal data assistant (PDA), a tablet computing device, or one or more processors within these devices, including physical instances, virtual instances, or both. The computer 302 can include input devices such as keypads, keyboards, and touch screens that can accept user information. Also, the computer 302 can include output devices that can convey information associated with the operation of the computer 302. The information can include digital data, visual data, audio information, or a combination of information. The information can be presented in a graphical user interface (UI) (or GUI). In some implementations, the inputs and outputs include display ports (such as DVI-I+2× display ports), USB 3.0, GbE ports, isolated DI/O, SATA-III (6.0 Gb/s) ports, mPCIe slots, a combination of these, or other ports. In instances of an edge gateway, the computer 302 can include a Smart Embedded Management Agent (SEMA), such as a built-in ADLINK SEMA 2.2, and a video sync technology, such as Quick Sync Video technology supported by ADLINK MSDK+. In some examples, the computer 302 can include the MXE-5400 Series processor-based fanless embedded computer by ADLINK, though the computer 302 can take other forms or include other components.

The computer 302 can serve in a role as a client, a network component, a server, a database, a persistency, or components of a computer system for performing the subject matter described in the present disclosure. The illustrated computer 302 is communicably coupled with a network 330. In some implementations, one or more components of the computer 302 can be configured to operate within different environments, including cloud-computing-based environments, local environments, global environments, and combinations of environments.

At a high level, the computer 302 is an electronic computing device operable to receive, transmit, process, store, and manage data and information associated with the described subject matter. According to some implementations, the computer 302 can also include, or be communicably coupled with, an application server, an email server, a web server, a caching server, a streaming data server, or a combination of servers.

The computer 302 can receive requests over network 330 from a client application (for example, executing on another computer 302). The computer 302 can respond to the received requests by processing the received requests using software applications. Requests can also be sent to the computer 302 from internal users (for example, from a command console), external (or third) parties, automated applications, entities, individuals, systems, and computers.

Each of the components of the computer 302 can communicate using a system bus. In some implementations, any or all of the components of the computer 302, including hardware or software components, can interface with each other or the interface 304 (or a combination of both), over the system bus. Interfaces can use an application programming interface (API), a service layer, or a combination of the API and service layer. The API can include specifications for routines, data structures, and object classes. The API can be either computer-language independent or dependent. The API can refer to a complete interface, a single function, or a set of APIs.

The service layer can provide software services to the computer 302 and other components (whether illustrated or not) that are communicably coupled to the computer 302. The functionality of the computer 302 can be accessible for all service consumers using this service layer. Software services, such as those provided by the service layer, can provide reusable, defined functionalities through a defined interface. For example, the interface can be software written in JAVA, C++, or a language providing data in extensible markup language (XML) format. While illustrated as an integrated component of the computer 302, in alternative implementations, the API or the service layer can be standalone components in relation to other components of the computer 302 and other components communicably coupled to the computer 302. Moreover, any or all parts of the API or the service layer can be implemented as child or submodules of another software module, enterprise application, or hardware module without departing from the scope of the present disclosure.

The computer 302 can include an interface 304. Although illustrated as a single interface 304 in FIG. 3, two or more interfaces 304 can be used according to particular needs, desires, or particular implementations of the computer 302 and the described functionality. The interface 304 can be used by the computer 302 for communicating with other systems that are connected to the network 330 (whether illustrated or not) in a distributed environment. Generally, the interface 304 can include, or be implemented using, logic encoded in software or hardware (or a combination of software and hardware) operable to communicate with the network 330. More specifically, the interface 304 can include software supporting one or more communication protocols associated with communications. As such, the network 330 or the interface's hardware can be operable to communicate physical signals within and outside of the illustrated computer 302.

The computer 302 includes a processor 305. Although illustrated as a single processor 305 in FIG. 3, two or more processors 305 can be used according to particular needs, desires, or particular implementations of the computer 302 and the described functionality. Generally, the processor 305 can execute instructions and can manipulate data to perform the operations of the computer 302, including operations using algorithms, methods, functions, processes, flows, and procedures as described in the present disclosure.

The computer 302 can also include a database 306 that can hold data for the computer 302 and other components connected to the network 330 (whether illustrated or not). For example, database 306 can be an in-memory, conventional, or a database storing data consistent with the present disclosure. In some implementations, database 306 can be a combination of two or more different database types (for example, hybrid in-memory and conventional databases) according to particular needs, desires, or particular implementations of the computer 302 and the described functionality. Although illustrated as a single database 306 in FIG. 3, two or more databases (of the same, different, or combination of types) can be used according to particular needs, desires, or particular implementations of the computer 302 and the described functionality. While database 306 is illustrated as an internal component of the computer 302, in alternative implementations, database 306 can be external to the computer 302.

The computer 302 also includes a memory 307 that can hold data for the computer 302 or a combination of components connected to the network 330 (whether illustrated or not). Memory 307 can store any data consistent with the present disclosure. In some implementations, memory 307 can be a combination of two or more different types of memory (for example, a combination of semiconductor and magnetic storage) according to particular needs, desires, or particular implementations of the computer 302 and the described functionality. Although illustrated as a single memory 307 in FIG. 3, two or more memories 307 (of the same, different, or combination of types) can be used according to particular needs, desires, or particular implementations of the computer 302 and the described functionality. While memory 307 is illustrated as an internal component of the computer 302, in alternative implementations, memory 307 can be external to the computer 302.

An application can be an algorithmic software engine providing functionality according to particular needs, desires, or particular implementations of the computer 302 and the described functionality. For example, an application can serve as one or more components, modules, or applications. Multiple applications can be implemented on the computer 302. Each application can be internal or external to the computer 302.

The computer 302 can also include a power supply 314. The power supply 314 can include a rechargeable or non-rechargeable battery that can be configured to be either user- or non-user-replaceable. In some implementations, the power supply 314 can include power-conversion and management circuits, including recharging, standby, and power management functionalities. In some implementations, the power-supply 314 can include a power plug to allow the computer 302 to be plugged into a wall socket or a power source to, for example, power the computer 302 or recharge a rechargeable battery.

There can be any number of computers 302 associated with, or external to, a computer system including computer 302, with each computer 302 communicating over network 330. Further, the terms "client," "user," and other appropriate terminology can be used interchangeably, as appropriate, without departing from the scope of the present disclosure. Moreover, the present disclosure contemplates that many users can use one computer 302 and one user can use multiple computers 302.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification includes many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

Figure 4:
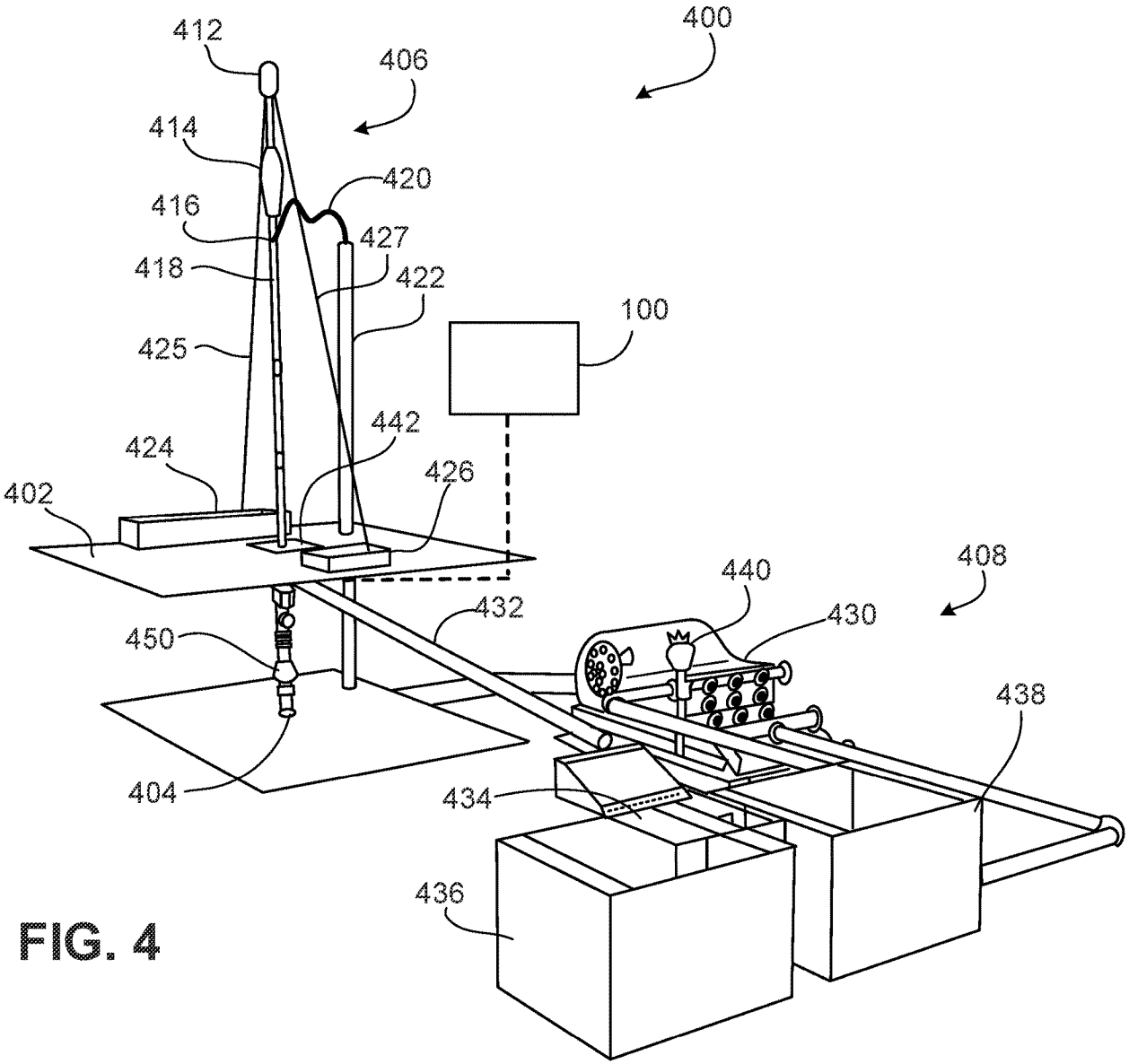
FIG. 4 is a partial schematic perspective view of an example rig system for drilling and producing a well, in accordance with some embodiments.

FIG. 4 is a partial schematic perspective view of an example rig system 400 for drilling and producing a well. As shown in FIG. 4, the rig system 400 can communicate with the system 100. The well can extend from the surface through the Earth to one or more subterranean zones of interest. The example rig system 400 includes a drill floor 402 positioned above the surface, a wellhead 404, a drill string assembly 406 supported by the rig structure, and a fluid circulation system 408 to filter used drilling fluid from the wellbore and provide clean drilling fluid to the drill string assembly 406. For example, the example rig system 400 of FIG. 4 is shown as a drill rig capable of performing a drilling operation with the rig system 400 supporting the drill string assembly 406 over a wellbore. The wellhead 404 can be used to support casing or other well components or equipment into the wellbore of the well.

The derrick or mast is a support framework mounted on the drill floor 402 and positioned over the wellbore to support the components of the drill string assembly 406 during drilling operations. A crown block 412 forms a longitudinally-fixed top of the derrick, and connects to a travelling block 414 with a drilling line including a set of wire ropes or cables. The crown block 412 and the travelling block 414 support the drill string assembly 406 via a swivel 416, a kelly 418, or a top drive system (not shown). Longitudinal movement of the travelling block 414 relative to the crown block 412 of the drill string assembly 406 acts to move the drill string assembly 406 longitudinally upward and downward. The swivel 416, connected to and hung by the travelling block 414 and a rotary hook, allows free rotation of the drill string assembly 406 and provides a connection to a kelly hose 420, which is a hose that flows drilling fluid from a drilling fluid supply of the circulation system 408 to the drill string assembly 406. A standpipe 422 mounted on the drill floor 402 guides at least a portion of the kelly hose 420 to a location proximate to the drill string assembly 406. The kelly 418 is a hexagonal device suspended from the swivel 416 and connected to a longitudinal top of the drill string assembly 406, and the kelly 418 turns with the drill string assembly 406 as the rotary table 442 of the drill string assembly turns.

In the example rig system 400 of FIG. 4, the drill string assembly 406 is made up of drill pipes with a drill bit (not shown) at a longitudinally bottom end of the drill string. The drill pipe can include hollow steel piping, and the drill bit can include cutting tools, such as blades, disc, rollers, cutters, or a combination of these, to cut into the formation and form the wellbore. The drill bit rotates and penetrates through rock formations below the surface under the combined effect of axial load and rotation of the drill string assembly 406. In some implementations, the kelly 418 and swivel 416 can be replaced by a top drive that allows the drill string assembly 406 to spin and drill. The wellhead assembly 404 can also include a drawworks 424 and a deadline anchor 426, where the drawworks 424 includes a winch that acts as a hoisting system to reel the drilling line in and out to raise and lower the drill string assembly 406 by a fast line 425. The deadline anchor 426 fixes the drilling line opposite the drawworks 424 by a deadline 427, and can measure the suspended load (or hook load) on the rotary hook. The weight on bit (WOB) can be measured when the drill bit is at the bottom the wellbore. The wellhead assembly 404 also includes a blowout preventer 450 positioned at the surface of the well and below (but often connected to) the drill floor 402. The blowout preventer 450 acts to prevent well blowouts caused by formation fluid entering the wellbore, displacing drilling fluid, and flowing to the surface at a pressure greater than atmospheric pressure. The blowout preventer 450 can close around (and in some instances, through) the drill string assembly 406 and seal off the space between the drill string and the wellbore wall. The blowout preventer 450 is described in more detail later.

During a drilling operation of the well, the circulation system 408 circulates drilling fluid from the wellbore to the drill string assembly 406, filters used drilling fluid from the wellbore, and provides clean drilling fluid to the drill string assembly 406. The example circulation system 408 includes a fluid pump 430 that fluidly connects to and provides drilling fluid to drill string assembly 406 via the kelly hose 420 and the standpipe 422. The circulation system 408 also includes a flow-out line 432, a shale shaker 434, a settling pit 436, and a suction pit 438. In a drilling operation, the circulation system 408 pumps drilling fluid from the surface, through the drill string assembly 406, out the drill bit and back up the annulus of the wellbore, where the annulus is the space between the drill pipe and the formation or casing. The density of the drilling fluid is intended to be greater than the formation pressures to prevent formation fluids from entering the annulus and flowing to the surface and less than the mechanical strength of the formation, as a greater density may fracture the formation, thereby creating a path for the drilling fluids to go into the formation. Apart from well control, drilling fluids can also cool the drill bit and lift rock cuttings from the drilled formation up the annulus and to the surface to be filtered out and treated before it is pumped down the drill string assembly 406 again. The drilling fluid returns in the annulus with rock cuttings and flows out to the flow-out line 432, which connects to and provides the fluid to the shale shaker 434. The flow line is an inclined pipe that directs the drilling fluid from the annulus to the shale shaker 434. The shale shaker 434 includes a mesh-like surface to separate the coarse rock cuttings from the drilling fluid, and finer rock cuttings and drilling fluid then go through the settling pit 436 to the suction pit 436. The circulation system 408 includes a mud hopper 440 into which materials (for example, to provide dispersion, rapid hydration, and uniform mixing) can be introduced to the circulation system 408. The fluid pump 430 cycles the drilling fluid up the standpipe 422 through the swivel 416 and back into the drill string assembly 406 to go back into the well.

The example wellhead assembly 404 can take a variety of forms and include a number of different components. For example, the wellhead assembly 404 can include additional or different components than the example shown in FIG. 4. Similarly, the circulation system 408 can include additional or different components than the example shown in FIG. 4.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of the present disclosure have been described. Nevertheless, it will be understood that various modifications may be made without departing from the spirit and scope of the present disclosure. Accordingly, other embodiments are within the scope of the following claims.

Various modifications, alterations, and permutations of the disclosed implementations can be made and will be readily apparent to those of ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

We claim:

1. A computer-implemented method to be performed by a drilling system, the method comprising:

periodically measuring using rig sensors of the drilling system real-time drilling data of a drilling operation of drilling a wellbore;

using the real-time drilling data to calculate at least one indicator of a tripping operation performed during the drilling operation;

calculating, based on the at least one indicator of the tripping operation, a value of an equivalent circulating density (ECD) in the wellbore;

detecting, based on the value of the ECD, a wellbore pressure change indicative of a drilling problem with the drilling operation;

determining to adjust a mud weight in the wellbore to avoid or mitigate the drilling problem;

calculating, based on the value of the ECD, a new value for the mud weight that avoids or mitigate the drilling problem; and controlling a fluid pump of a circulation system of the drilling system such that the mud weight is less than or equal to the new value to avoid or mitigate the drilling problem.

2. The computer-implemented method of claim 1, wherein the method further comprises:

determining to adjust a movement speed of a drill pipe to further avoid or mitigate the drilling problem;

calculating, based on the ECD, a new value for the movement speed of the drill pipe to further avoid or mitigate the drilling problem; and controlling the movement speed of the drill pipe to the new value to further avoid or mitigate the drilling problem.

3. The computer-implemented method of claim 1, wherein the method further comprises:

determining to adjust a rate of penetration for a drilling tool of the drilling system to further avoid or mitigate the drilling problem;

determining, based on the ECD, the rate of penetration for the drilling tool to further avoid or mitigate the drilling problem; and controlling the drilling tool such that the rate of penetration of the drilling tool is less than or equal to the determined rate of penetration to further avoid or mitigate the drilling problem.

4. The computer-implemented method of claim 3, wherein determining the rate of penetration for the drilling tool is further based on a pore pressure limit and a fracture pressure limit.

5. The computer-implemented method of claim 1, wherein the method further comprises:

displaying, via a graphical user interface (GUI), drilling instructions to perform one or more actions to avoid or mitigate the drilling problem.

6. The computer-implemented method of claim 1, wherein the least one indicator of the tripping operation comprises a surge pressure profile.

7. The computer-implemented method of claim 1, wherein calculating at least one indicator of the tripping operation is based on at least one of: (1) a modified carrying capacity index (CCI), (2) a modified cuttings concentration in annulus (CCA), (3) a transport ratio (TR) efficiency (TRE), (4) an effective drilling fluid density (MWeff), or (5) transport index (TI).

8. One or more non-transitory computer-readable storage media coupled to one or more processors and having instructions stored thereon which, when executed by the one or more processors, cause the one or more processors to perform operations comprising:

periodically measuring using rig sensors of a drilling system real-time drilling data of a drilling operation of drilling a wellbore;

using the real-time drilling data to calculate at least one indicator of a tripping operation performed during the drilling operation;

calculating, based on the at least one indicator of the tripping operation, a value of an equivalent circulating density (ECD) in the wellbore;

detecting, based on the value of the ECD, a wellbore pressure change indicative of a drilling problem with the drilling operation;

determining to adjust a movement speed of a drill pipe to avoid or mitigate the drilling problem;

calculating, based on the ECD, a new value for the movement speed of the drill pipe to avoid or mitigate the drilling problem; and controlling the movement speed of the drill pipe to the new value to avoid or mitigate the drilling problem.

9. The one or more non-transitory computer-readable storage media of claim 8, wherein the operations further comprise:

determining to adjust a mud weight in the wellbore to further avoid or mitigate the drilling problem;

calculating, based on the value of the ECD, a new value for the mud weight to further avoid or mitigate the drilling problem; and controlling a circulation system of the drilling system such that the mud weight is less than or equal to the new value to further avoid or mitigate the drilling problem.

10. The one or more non-transitory computer-readable storage media of claim 8, wherein the operations further comprise:

determining to adjust a rate of penetration for a drilling tool of the drilling system to further avoid or mitigate the drilling problem;

determining, based on the ECD, the rate of penetration for the drilling tool to further avoid or mitigate the drilling problem; and controlling the drilling tool such that the rate of penetration of the drilling tool is less than or equal to the determined rate of penetration to further avoid or mitigate the drilling problem.

11. The one or more non-transitory computer-readable storage media of claim 10, wherein determining the rate of penetration for the drilling tool is further based on a pore pressure limit and a fracture pressure limit.

12. The one or more non-transitory computer-readable storage media of claim 8, wherein the operations further comprise:

displaying, via a graphical user interface (GUI), drilling instructions to perform one or more actions to avoid or mitigate the drilling problem.

13. The one or more non-transitory computer-readable storage media of claim 8, wherein the least one indicator of the tripping operation comprises a surge pressure profile.

14. The one or more non-transitory computer-readable storage media of claim 8, wherein calculating at least one indicator of the tripping operation is based on at least one of: (1) a modified carrying capacity index (CCI), (2) a modified cuttings concentration in annulus (CCA), (3) a transport ratio (TR) efficiency (TRE), (4) an effective drilling fluid density (MWeff), or (5) transport index (TI).

15. A system comprising:

or more processors configured to perform operations comprising:

periodically measuring using rig sensors of a drilling system real-time drilling data of a drilling operation of drilling a wellbore;

using the real-time drilling data to calculate at least one indicator of a tripping operation performed during the drilling operation;

calculating, based on the at least one indicator of the tripping operation, a value of an equivalent circulating density (ECD) in the wellbore;

detecting, based on the value of the ECD, a wellbore pressure change indicative of a drilling problem with the drilling operation;

determining a corrective action to avoid or mitigate the drilling problem, wherein the corrective action comprises adjusting a movement speed of a drill pipe;

calculating, based on the ECD, a new value for the movement speed of the drill pipe; and controlling the movement speed of the drill pipe to the new value.

16. The system of claim 15, wherein the operations further comprise:

determining to adjust a mud weight in the wellbore to further avoid or mitigate the drilling problem;

calculating, based on the value of the ECD, a new value for the mud weight to further avoid or mitigate the drilling problem; and controlling a circulation system of the drilling system such that the mud weight is less than or equal to the new value to further avoid or mitigate the drilling problem.

17. The system of claim 15, wherein the operations further comprise:

determining to adjust a rate of penetration for a drilling tool of the drilling system to further avoid or mitigate the drilling problem;

determining, based on the ECD, the rate of penetration for the drilling tool to further avoid or mitigate the drilling problem; and controlling the drilling tool such that the rate of penetration of the drilling tool is less than or equal to the determined rate of penetration to further avoid or mitigate the drilling problem.

* * * * *